US005185957A

United States Patent [19]

Mizuguchi et al.

[11] Patent Number: 5,185,957

[45] Date of Patent: Feb. 16, 1993

[54] MICRO-ABRADING METHOD AND MICRO-ABRADING TOOL

[75] Inventors: Shinichi Mizuguchi, Katano; Shuji Ueda, Neyagawa; Koji Kato; Noritsugu Umehara, both of Sendai, all of Japan

[73] Assignee: Matsushita Electric Co., Ltd., Osaka, Japan

[21] Appl. No.: 708,867

[22] Filed: May 31, 1991

[30] Foreign Application Priority Data

Jun. 1, 1990 [JP] Japan ..... 2-144724
Jun. 1, 1990 [JP] Japan ..... 2-144725

[51] Int. Cl.[5] ..... B24B 1/04

[52] U.S. Cl. ..... 51/59 SS; 51/60; 51/317

[58] Field of Search ..... 51/59 SS, 281 R, 317, 51/328, DIG. 11, 165.77; 83/701; 173/11, 4

[56] References Cited

U.S. PATENT DOCUMENTS 2,834,158 5/1958 Petermann ..... 51/59 SS
3,427,480 2/1969 Robinson ..... 51/59 SS
5,076,026 12/1991 Mizuguchi et al. ..... 51/59 SS

*Primary Examiner*—Bruce M. Kisliuk
*Assistant Examiner*—Bryan Reichenbach
*Attorney, Agent, or Firm*—Wenderoth, Lind & Ponack

[57] ABSTRACT

A micro-abrading method wherein an abrading section undergoes a micromotion in the XY-direction parallel with the surface of a workpiece according to the operation of an actuator comprising piezoelectric elements, and an abrading material is held between the abrading section positioned at the lower end of an abrading tool and the workpiece. The phase difference between the X-direction motion and the Y-direction motion is cyclically changed while the abrading section is undergoing the micromotion, and the surface of the workpiece is entirely and uniformly abraded even though a large area is abraded.

13 Claims, 5 Drawing Sheets

$\delta = 0°$ $0 < \delta < 90°$ $\delta = 90°$ $90° < \delta < 180°$ $\delta = 180°$ $180° < \delta < 270°$ $\delta = 270°$ $270° < \delta < 360°$

MICRO-ABRADING METHOD AND MICRO-ABRADING TOOL

BACKGROUND OF THE INVENTION

1. Field of the Invention

The present invention relates to a micro-abrading method and a micro-abrading tool and more particularly to a method for abrading a micro-region accurately in order to process a lens or an optical element with a high accuracy and an abrading tool to be used in carrying out the method.

2. Description of the Related Arts

It is necessary to abrade a nonspherical lens, an X-ray optical element, and the like incorporated in electronic equipment or an optical instrument. There is a demand for the development of a method for abrading a workpiece so that the workpiece has a configuration accuracy of as high as 0.01 μm. To this end, it is necessary to abrade a very small area of the surface of the workpiece accurately from one area to the other.

Polishing processes or lapping processes have been adopted to abrade workpieces with high accuracy. But according to the conventional method, it is impossible to abrade the workpiece as accurately as less than 0.01 μm. In order to overcome this problem, a magnetic abrading method using a magnetic abrading fluid as an abrading material has been developed recently. The term magnetic abrading fluid means magnetic fluid itself or an abrading material of fine particles suspended in the magnetic fluid.

According to the magnetic abrading method, magnetic abrading fluid is supplied between an abrading section positioned at the lower end of an abrading tool and a workpiece, and a magnetic field is formed therebetween. The magnetic abrading fluid is held between the abrading section and the workpiece according to a magnetic action with the magnetic abrading fluid applying pressure to the surface of the workpiece. When the abrading tool is rotated at a high speed in this condition, the magnetic abrading fluid is rotated at a high speed. As a result, magnetic abrading fluid abrades the surface of the workpiece. In this operation, in order to improve abrading efficiency, the direction and intensity of the magnetic field are changed to fluctuate pressure be applied by the magnetic abrading fluid to the surface of the workpiece and the motion of the magnetic abrading fluid is controlled. This magnetic abrading method is disclosed, for example, in Japanese Patent Laid-Open Publication No. 60-118466, Japanese Patent Laid-Open Publication No. 61-244457, and Examined Japanese Patent Publication No. 1-16623.

According to this magnetic abrading method, the magnetic holding force allows the abrading material to act concentratively on a very small area of the surface of the workpiece. Therefore, compared with the conventional abrading method, the workpiece can be abraded with a high accuracy. But even this magnetic abrading method is incapable of abrading the workpiece as accurate as less than 0.01 μm.

That is, according to this method, since the magnetic abrading fluid is rotated at a very high speed by the abrading tool, abrading accuracy depends on the condition of the rotation of the abrading tool. When the abrading tool rotates, the number of rotations of the abrading tool fluctuates or a shaft deflection occurs. According to this method, the amount of abrasion fluctuates, the surface of the workpiece is locally abraded, and the area to be abraded fluctuates. It is necessary that a rotary mechanism has a spacial allowance so that each member makes a motion smoothly. Therefore, the motion of the abrading section is unstable more or less unstable and the surface of the workpiece is not uniformly and accurately abraded. That is, it is impossible to prevent the occurrence of the above problem when the abrading section rotates at a high speed.

According to the magnetic abrading method in which the abrading tool rotates at a high speed, the pressure for pressing the magnetic abrading fluid against the surface of the workpiece is not generated by the rotation of the abrading tool but by the application of the magnetic force, as described above. Therefore, unless the intensity of the magnetic force is high, a sufficient abrading force is not generated. The amount of abrasion of the workpiece changes with the fluctuation of the intensity of the magnetic force. This results in the magnetic force generating means, such as an electromagnet, being large and it is necessary to strictly control the intensity of the magnetic force. Further, in a magnetic circuit for obtaining the pressure for pressing the magnetic abrading fluid against the surface of the workpiece, it is necessary for the workpiece constitute a part of the magnetic circuit. Therefore, it is essential that the workpiece is magnetically conductive, namely, consists of a magnetic material. But if the workpiece is thin, a magnetic circuit can be constituted through the nonmagnetic materials. The pressure of the magnetic abrading fluid to be applied to the workpiece surface changes due to slight fluctuations in the thickness and magnetic properties of the workpiece. Therefore, it is difficult to adjust the abrasion amount and abrasion accuracy. Since the lens and the optical elements are non-magnetic and fairly thick, the magnetic abrading method in which an abrading tool rotates at a high speed cannot be applied to abrade them.

In order to solve the above problem, the present inventors developed a micro-abrading method and an abrading tool to be used in carrying out the method. According to the invention, actuators comprising piezoelectric elements are in motion in the XY-direction parallel with a workpiece surface and in the Z-direction perpendicular to the workpiece surface. The micromotion of the abrading section is transmitted to the magnetic abrading fluid so as to abrade the workpiece surface. Thus, the method and the tool therefor are capable of abrading the workpiece accurately, irrespective to the magnetic properties of a workpiece, and can be favorably applied to a workpiece comprising a nonmagnetic material.

According to this method and the abrading tool therefor using the actuators comprising piezoelectric elements, it is unnecessary to rotate the abrading section at a high speed and constitute a workpiece as a part of a magnetic circuit provided to hold the magnetic abrading fluid and apply pressure to the magnetic abrading fluid. Therefore, this invention is capable of completely solving the above-described conventional problems.

That is, according to this method employing a novel driving system, the piezoelectric elements cause the magnetic abrading fluid to be pressed against the workpiece and move the abrading section by a slight amount along the surface of the workpiece. Thus, the workpiece is abraded. That is, the piezoelectric elements are used to, move the X-direction and Y-direction actuators and the Z-direction actuator of the abrading section by a slight amount so that the magnetic abrading fluid moves along the surface of the workpiece by a slight amount horizontally or vertically. The magnetic abrading fluid abrades the surface of the workpiece little by little due to its slight horizontal motion slight amount and applies pressure to the surface of the workpiece due to its slight vertical motion.

As described above, according to this method utilizing the novel driving system, it is unnecessary to rotate the abrading section. The actuators comprising piezoelectric elements include no sliding section or operating mechanism and are accurately driven according to an applied voltage. Thus, the magnetic abrading fluid undergoes a stable motion, which does not bring about unevenness or local abrasion of the workpiece surface. Since the amount of the actuator-operated motion of the magnetic abrading fluid in the XY-direction is smaller than that of a rotary motion of a shaft adopted conventionally, the workpiece can be finely abraded to a mirror-like surface finish with a high accuracy.

According to this method, since the magnetic abrading fluid is pressed against the workpiece by the piezoelectric elements constituting the Z-direction actuator, there is no need for providing a magnetic circuit connecting the abrading section of the abrading tool with the workpiece. Therefore, even though the workpiece is non-magnetic, it can be abraded in a manner similar to a magnetic workpiece. Since the pressure to be applied to the workpiece can be adjusted by appropriately setting the voltage of the actuator irrespective of the magnetic properties of the workpiece which often differ from each other due to material quality and the thickness thereof, abrading efficiency and abrading accuracy are not affected by the material quality and configuration of the workpiece. This method is capable of abrading a magnetic material such as steel which can be abraded by the conventional magnetic abrading method in which an abrading tool rotates at a high speed and, in addition, a non-magnetic material such as glass or ceramic which cannot be abraded by the conventional magnetic abrading method in which an abrading tool rotates at a high speed. Further, this method is capable of processing workpieces into a flat surface, a spherical surface, or a free-curved surface irrespective of the thickness thereof.

According to this abrading method employing the novel driving system, as described above, the slight motion of the abrading section is obtained by applying a voltage to piezoelectric elements. Accordingly, the magnetic abrading fluid is capable of abrading the workpiece surface uniformly and finely in a very small area in the vicinity of the abrading section. Compared with the conventional magnetic abrading method in which an abrading tool rotates at a high speed, the workpiece can be abraded uniformly and a very accurate mirror-like surface finish can be attained. That is, the workpiece can be abraded with a configuration accuracy of less than 0.01 $\mu$m with ease and reliability.

This micro-abrading method and the abrading tool therefor can be applied to a method in which the magnetic abrading fluid is not used as the abrading material.

However, research made thereafter has revealed that this method has the following problems.

That is, according to the method utilizing this novel driving system, if the diameter of the abrading section is increased by enlarging the motion range thereof, the configuration of the abraded portion becomes non-uniform and a preferable spherical surface is not obtained, i.e., a smooth mirror-like surface finish cannot be obtained.

The reason the above problems occur is as follows:

According to the above-described micro-abrading method, the abrading section makes a cyclical motion, i.e., forms a circular arc-shaped Lissajous's figure about a supporting point according to the operational force of the XY-direction actuator which fluctuates cyclically. The workpiece surface is spherically abraded according to the motion of the abrading section. The abrading section is supported by the Z-direction actuator as well so that it is capable of moving not only in XY-direction, but also the Z-direction. But, the Z-direction actuator comprises piezoelectric elements which are not as rigid as the constructing material. Therefore, when the operation of the abrading section in the XY-direction becomes great, the supporting portion of the motion of the abrading section, namely, the Z-direction actuator, moves in the XY-direction. As a result, the motion locus of the abrading section becomes irregular and an accurate configuration of the circular-arc Lissajous's figure cannot be obtained.

FIG. 6 illustrates a sectional configuration of the motion locus T of the abrading section and an abraded surface H' formed on a workpiece W. The motion of the abrading section is determined by an excitation frequency applied to the X-direct-ion actuator and Y-direction actuator. Accordingly, the motion of the abrading section is expressed by the composition of an X-direction component $X=A \sin \omega t$ and a Y-direction component $Y=A \sin (\omega t+90°)$. That is, the abrading section forms a circular arc of a radius A. In order to increase the radius of the abrading section, the amplitude of the excitation frequency to be applied to the XY-direction actuator is increased so that the radius A of the motion locus T becomes large.

However, the surface of the workpiece is abraded spherically with a center at the position of the abrading section according to the motion of the abrading section. As a result, the surface of the workpiece is concaved circularly along the circumference of radius A. That is, the abrading section does not pass the center of the abraded area H' and as a result, a portion Q remains unabraded and projecting in the center of an abraded area H. When the radius A is small, the projected portion Q is small and not outstanding. But if the radius A is large, the projected portion Q is outstanding. Hence, abrading accuracy is not favourable.

SUMMARY OF THE INVENTION

It is therefore an essential object of the present invention to provide a micro-abrading method, using a novel driving system, for abrading a workpiece surface smoothly into a concaved configuration without a projected portion being left thereon and a micro-abrading tool for carrying out the method.

In accomplishing this and other objects, the micro-abrading method according to the present invention and the micro-abrading tool therefor are as follows:

An abrading section undergoes a micromotion in the XY-direction parallel with the surface of a workpiece according to the operation of an actuator comprising piezoelectric elements, with an abrading material held between the abrading section positioned at the lower end of an abrading tool and the workpiece. The phase difference between the micromotion of the abrading section in the X-direction and the micromotion of the abrading section in the Y-direction is cyclically changed to abrade the surface of the workpiece.

Similarly to the conventional abrading method in which an abrading tool rotates at a high speed, the abrading section positioned at the lower end of the abrading tool is moved with the abrading tool supported by an appropriate supporting means. The supporting means and a means for moving the abrading section are known.

The abrading tool allows the abrading section to undergo a micromotion in a direction parallel with the workpiece surface, namely, in the XY-direction and also in a direction perpendicular to the workpiece surface, namely, in the Z-direction as necessary according to the configuration and purpose of the workpiece. A workpiece surface having a complicated curved configuration can be abraded favorably by tilting a supporting shaft.

The workpiece is abraded according to the material property and configuration of the abrading section. The abrading section is Sn-plated or consists of polyurethane. If the abrading section is flat, corners thereof contact the workpiece surface. Therefore, it is preferable that the surface of the polishing section is spherical. If the abrading section is made of polyurethane, preferably, the amplitude of the micromotion of the abrading section in the XY-direction is larger than the cavity diameter of the polyurethane because the workpiece surface is not partially but uniformly abraded throughout the entire surface.

It is preferable that the spherical abrading section is rotatably held at the lower end of the abrading tool. This construction prevents the abrading section from being locally abraded. The sphere may be mechanically held like a sphere of a bearing mechanism, magnetically or by the viscosity of the abrading material.

Not only magnetic fluid but also non-magnetic fluid can be used to abrade the workpiece.

Similarly to known magnetic abrading fluid, the magnetic abrading fluid has not only magnetic properties but also abrading properties. Normally, the magnetic fluid is made of $Fe_3O_4$ of fine magnetic particles less than 10 nm in diameter which is dispersed in a colloidal solution of water or oil. If the magnetic particles are capable of abrading the workpiece, the magnetic fluid comprising the magnetic particles can be used as is. Red iron oxide ($\alpha$-$Fe_3O_4$) is an example of the magnetic abrading particle. An abrading particle may be formed by suspending known non-magnetic abrading particles such as $Al_23$ or $SiO_2$ in magnetic fluid consisting of magnetic particles having no abrading properties. Preferably, the size of a particle is less than 100 nm.

In order to magnetically hold the magnetic abrading fluid between the abrading section positioned at the lower end of the abrading tool and the workpiece, a magnetic circuit is constituted by providing a magnetic yoke in the vicinity of the abrading section at the lower end of the abrading tool. Thus, the magnetic abrading fluid can be easily held in the vicinity of the abrading section due to the magnetic action thereof.

The actuator consisting of piezoelectric elements for moving the abrading section by a small amount is stretched and contracted by applying a voltage thereto. The abrading section can be moved by a slight amount by applying a voltage which cyclically fluctuates to the actuator connected with the abrading section. The frequency of the micromotion of the actuator is changed according to the frequency of an applied voltage and the amplitude of the micromotion thereof is changed according to the intensity of the applied voltage. As a result of the transmission of the micromotion of the abrading section to the abrading material, the abrading material undergoes a similar micromotion. Thus, the workpiece is abraded.

The X-direction actuator moves the abrading section by a slight amount in X-direction parallel with the workpiece surface and the Y-direction actuator moves the abrading section by a slight amount in the Y-direction parallel with the workpiece surface and perpendicular to the X-direction, thus moving the abrading material by a slight amount in parallel with the surface of the workpiece. Thus, the workpiece surface is abraded. The abrading section is moved by the X-direction and Y-direction actuators by controlling the phase of the motion of the abrading section in the X-direction and the phase of the motion of the abrading section in the Y-direction. That is, the abrading section undergoes a micromotion in an arbitrary Lissajous's figure. The cyclic change of the phase difference between the motion in the X-direction and the motion in the Y-direction allows the locus of the abrading section, namely, Lissajous's figure to be changed successively and cyclically in a complicated Lissajous's figure, for example, between a circular arc, a straight line and an ellipse. The phase of the X-direction motion relative to the Y-direction motion is changed by maintaining the vibration of the abrading section constant, for example, in the X-direction and changing the vibration in the Y-direction. Otherwise, the phase in the X-direction and the Y-direction may be both changed. The phase difference of the X-direction motion and the Y-direction motion of the abrading section is controlled by transmitting phase-differentiated signals to the X-direction actuator and Y-direction actuator. To this end, the driving circuit of the X-direction actuator and the Y-direction actuator is connected with a variable phase signal generator capable of changing the phase of a signal.

The Z-direction actuator moves the abrading section in a direction perpendicular to the surface of the workpiece so that the abrading material collides with the workpiece surface in a direction perpendicular thereto. Thus, pressure is applied to the workpiece. Accordingly, the pressure to be applied to the workpiece can be controlled according to a voltage applied to the Z-direction actuator. The polishing material is sequentially supplied to the workpiece owing to the pumping operation of the abrading section caused by the micromotion of the Z-direction actuator.

The wiring for applying a voltage to the X-direction, Y-direction, and Z-direction actuators are separately provided. The end of each of the X-direction, Y-direction, and Z-direction actuators is moved a slight distance in the X-direction, the Y-direction, and the Z-direction, respectively, by appropriately adjusting a voltage to be applied to the actuators. The wiring through which a voltage is applied to each actuator is connected with a driving amplifier and a function generator. The construction of the driving circuit and the driving mechanism is similar to a known one in which an actuator is used.

Preferably, the X-direction, Y-direction, and Z-direction actuators are composed of piezoelectric elements superimposed one on the other. These actuators stretch and contract by applying a voltage to, both ends of each actuator, thus creating micromotion in the X-direction, the Y-direction, and the Z-direction, respectively. The use of the above superimposed piezoelectric elements provides a large displacement and prevents the displacement of the micromotion thereof in the XY-direction from fluctuating irrespective of the magnitude of the external force.

Normally, the X-direction, Y-direction, and Z-direction actuators drive a shaft, having the abrading section at its lower end, slightly in horizontal and vertical directions in order to drive the abrading section.

As described above, the pressure applied by the abrading material to the workpiece depends on the force applied by the Z-direction actuator. If the abrading material is magnetically held between the abrading section and the workpiece, the holding force is also applied to the workpiece. But the pressure applied by the abrading material to the workpiece decreases with the progress of the abrading operation, or the elapse of time. Therefore, it is preferable to control the pressure applied by the abrading material to the workpiece by detecting the value of a load applied to the workpiece and performing a feedback control to the Z-direction actuator. As a load detecting means for detecting the value of the load, a known pressure sensor can be used if it is capable of detecting the load applied to the workpiece in a direction perpendicular to the workpiece. A load cell detects a load applied to the workpiece placed thereon, thus outputting an electric signal to the driving amplifier via a controller.

The value of the load detected by the load detecting means is converted into an electric signal to control the operation of the actuator. More specifically, the signal is processed by an appropriate electric circuit and inputted to the driving circuit for applying a voltage to the actuator. Then, the detected value of the load is compared with a predetermined reference value. According to a detected result, a voltage is increasingly or decreasingly applied to the Z-direction actuator. That is, the pressure to be applied by the Z-direction actuator to the workpiece is feedback-controlled. The feedback control is performed by keeping the pressure to be applied by the Z-direction actuator to the workpiece at a predetermined value, making it large in the early stage of the abrading operation (rough abrasion), intermediate in the middle stage (intermediate abrasion), and small in the late stage (finish abrasion). Preferably, the pressure to be applied by the Z-direction actuator to the workpiece is kept at a constant value during each stage.

In keeping the pressure in Z-direction constant, the abrading material is sequentially supplied to and discharged from the workpiece surface owing to the pumping operation of the abrading section caused by vibration added to the pressure of the Z-direction actuator.

The pressure of the Z-direction actuator is determined according to the quality of the workpiece and a required abrading accuracy.

When magnetic abrading fluid is used as the abrading material, a central yoke, constituting a magnetic circuit for holding magnetic force, acts as the shaft of the abrading tool. Therefore, the shaft of the abrading tool consists of a magnetic material. Yokes (opposite yokes) opposed to the central yoke are arranged so that a magnetic gap is provided between the abrading section positioned at the lower end of the central yoke and the opposite yokes. For example, cylindrical opposite yokes are arranged such that they surround the sectionally circular central yoke with an interval provided therebetween. Thus, the magnetic abrading fluid can be preferably held in the periphery of the abrading section of the central yoke. Bar-shaped or plate-shaped opposite yokes may be arranged alongside the central yoke. Since the opposite yokes compose a part of the magnetic circuit, needless to say, they consist of a magnetic material. Preferably, the end of each opposite yoke is narrowed so that magnetic force concentrates in the end portion of the opposite yoke.

A magnetic circuit is constituted by connecting the central yoke and the opposite yokes with a magnetism generating means. Since it is unnecessary to change the direction and magnitude of a magnetic field according to the present invention, a permanent magnet is preferably used rather than an electromagnet as the magnetism generating means. The permanent magnet consists of a Sm-Co magnet.

A Lissajous's figure, namely, a motion locus is determined by the phase difference between the micromotion of the abrading section in the X-direction and the micromotion thereof in the Y-direction. According to the conventional method, the micromotion of the abrading section phase in the X-direction is in phase with the micromotion of the abrading section in the Y-direction. Therefore, the motion locus is a circular arc and the abrading section does not pass the center of the locus. Thus, some portions of the surface of the workpiece are not abraded sufficiently and a projected portion is formed.

The cyclic change of the phase difference between the micromotion of the abrading section in the X-direction and the micromotion thereof in the Y-direction changes the Lissajous's figure with the elapse of time, for example, from a circular arc or a straight line, to an ellipse. That is, the abrading section passes over the entire area of the motion range. As a result, the surface of the workpiece is uniformly and favorably abraded throughout the motion range, so that the entire workpiece surface is smoothly concaved.

The Z-direction actuator is connected with the abrading section via the connecting section so that the abrading section is capable of undergoing a micromotion in the XY-direction, and the X-direction and Y-direction actuators operate between the connecting section and the abrading section. As a result, the X-direction and Y-direction actuators allow for a smooth micromotion of the abrading section in the X-direction, and the pressure of the Z-direction actuator can be reliably transmitted to the abrading section.

However, according to this method, when the motion range of the abrading section is large, the connecting section, serving as the supporting point of the abrading section in making a micromotion in the Y-direction, and the Z-direction actuator are moved in the XY-direction due to the motion of the abrading section. With the movement of the supporting point, the motion locus of the abrading section described with the supporting point at the reference point is irregular. That is, the abrading section vibrates in such a manner that a multiple-frequency component is added to the cyclic stretch/contraction vibration of the X-direction and Y-direction actuators.

The limitation of the motion of the Z-direction actuator in the XY-direction prevents the Z-direction actuator and the connecting section from moving in the XY-direction, and the abrading section undergoes a motion in a predetermined accurate locus. The abrading section describes a predetermined accurate locus. Since the Z-direction actuator and the connecting section do not undergo a motion in the XY-direction, the above-described high degree multiple-frequency component at the high degrees is not generated. Therefore, only the X-direction and Y-direction actuators vibrate the abrading section according to the cyclic stretch and contraction thereof. As a result, the surface of the workpiece is accurately, smoothly, and uniformly abraded.

BRIEF DESCRIPTION OF THE DRAWINGS

These and other objects and features of the present invention will become apparent from the following description taken in conjunction with the preferred embodiments thereof with reference to the accompanying drawings, in which.

FIG. *7a* is a sectional view of a processed surface of a workpiece according to an embodiment of the present invention; and FIG. *7b* is a sectional view of a processed surface of a workpiece according to a comparison example.

DETAILED DESCRIPTION OF THE INVENTION

The embodiments of the present invention will be described with reference to the accompanying drawings.

Figure 1:
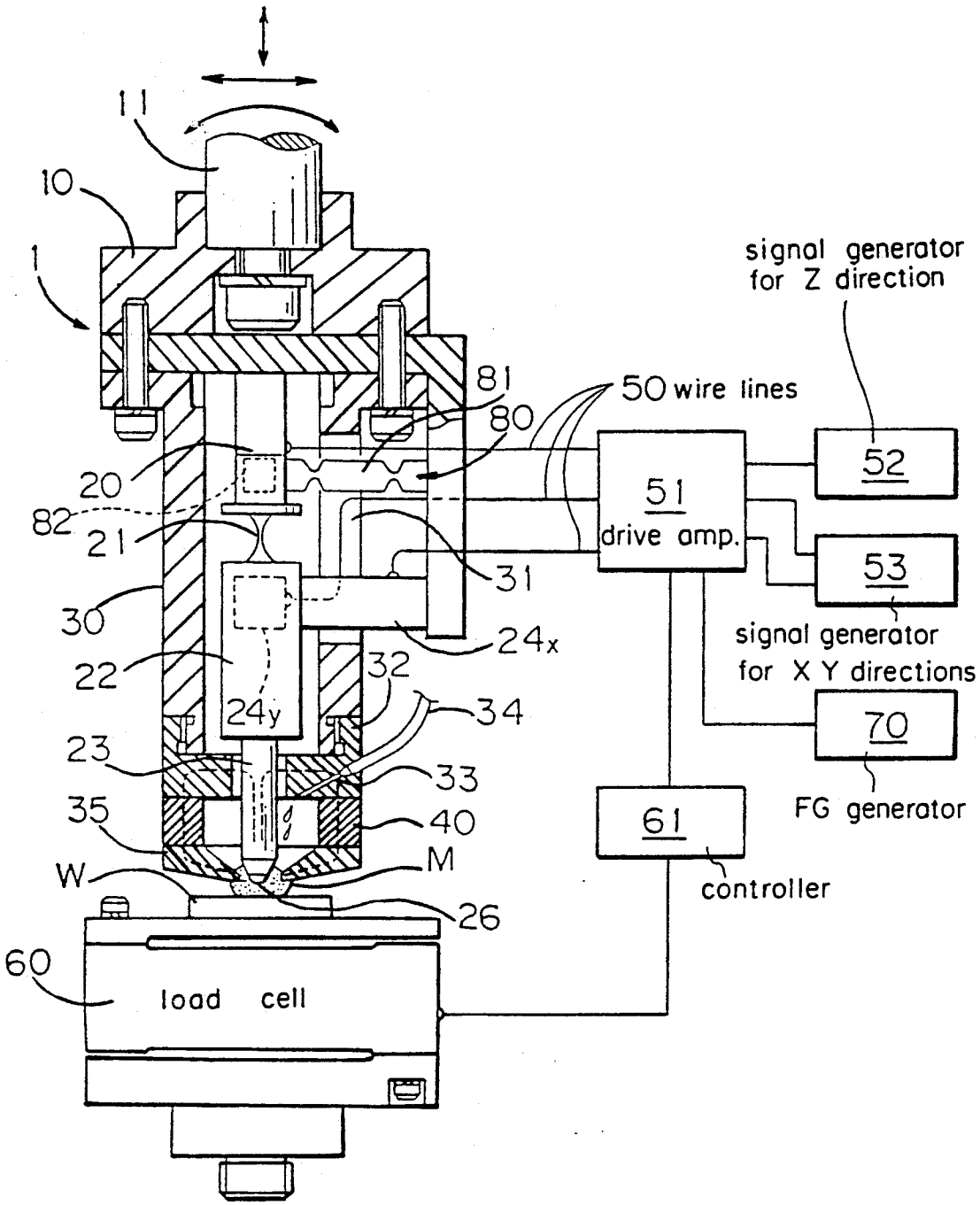
FIG. 1 is a sectional view showing an abrading tool serving as the principal portion of an abrading apparatus to be used in a micro-abrading method according to an embodiment of the present invention.

FIG. 1 shows an abrading tool which is the principal section of an abrading apparatus to be used in carrying out an abrading method according to the present invention. The main body section 10 of the abrading tool 1 is fixed to the main body (not shown) of the abrading apparatus by a supporting shaft 11. The supporting shaft 11 is movable horizontally and vertically and tiltable at any angle. The operation mechanism of the supporting shaft 11 is similar to that of the shaft of a known machine tool.

A Z-direction actuator 20 extends vertically or in the Z-direction from the center of the lower surface of the main body section 10. A block 22 is hung from the lower surface of the Z-direction actuator 20 via a connecting section 21 having the following connecting operation. That is, the connecting section 21 has the function of allowing the block 22 to move slightly in the Y-direction (vertical with respect to the horizontal sheet showing FIG. 1) perpendicular to the Z-direction and reliably transmitting the motion of the Z-direction actuator 20, which occurs in the Z-direction, to the block 22.

The Z-direction actuator 20 is connected with the main body 10 at a portion immediately above the connecting section 21 via a regulating fixture 80 serving as a means for regulating the motion of the Z-direction actuator 20 in XY-direction which is described later.

Figure 2:
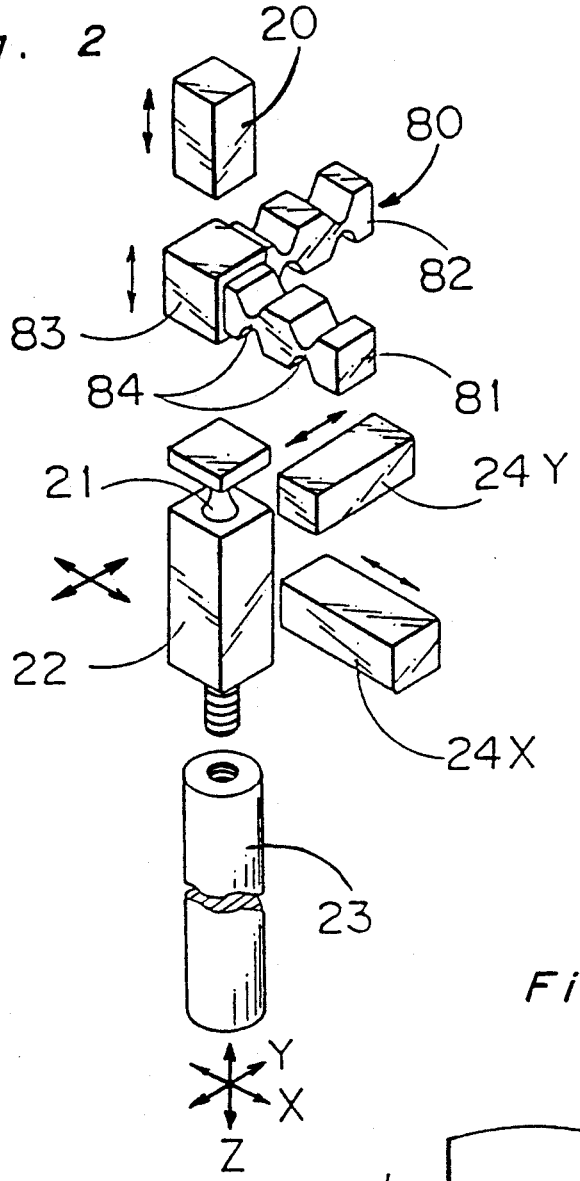
FIG. 2 is an exploded perspective view showing actuators.

FIG. 2 shows the detailed construction of the regulating fixture 80. The regulating fixture 80 comprises a central section 83 sandwiched between the actuator 20 and the connecting section 21; and supporting sections 81 and 82 extending from the central section 83 in the XY-direction. The other ends of the supporting sections 81 and 82 are fixed to the main body 10 of the tool 1. Narrow portions 84 are defined in the supporting sections 81 and, 82 so that the supporting sections 81 and 82 can be flexed vertically. Therefore, the Z-direction actuator 20 is incapable of moving in the axial direction of the supporting sections 81 and 82, namely, in the XY-direction, but stretches and contracts in the Z-direction, namely, the flexing direction of the narrow portion 84 of the supporting sections 81 and 82.

A central yoke 23 serving as an abrading shaft is screw-connected with the block 22 at the lower end thereof. An X-direction actuator 24*x* is horizontally connected with the block 22 at an upper portion thereof and a Y-direction actuator 24*y* is horizontally connected with the block 22 at an upper portion thereof such that the X-direction actuator 24*x* and the Y-direction actuator 24*y* are at a right angle with each other. According to this embodiment, the Z-direction actuator 20, the X-direction actuator 24*x*, and the Y-direction actuator 24*y* comprise a great number of thin piezoelectric elements superimposed one on the other. These actuators 20, 24*x*, and 24*y* are stretched or contracted in Z-direction (axial direction of the central yoke 23), the X-direction, and the Y-direction, respectively, by applying a voltage. A slight motion of the Z-direction actuator 20 in the Z-direction brings an abrading material into contact with a workpiece. The combination of a slight motion of the X-direction actuator 24*x* in the X-direction and the Y-direction actuator 24*y* in the Y-direction allows the abrading material to move freely on the surface of the workpiece.

The specifications of the actuators 20, 24*x*, and 24*y* is as shown in Table 1.

TABLE 1

| size mm | pentagon × 18 in length |
|---|---|
| rated voltage V | 100 |
| displacement amount μm/V | 15/100 |
| excitation frequency Hz | 10 ~ 300 |

The yoke 23 is narrowed toward its lower end portion which is spherical. The spherical surface serves as an abrading section 26. The abrading section 26 may consist of a Sn-plated layer or a polyurethane layer. When polyurethane is used as the abrading section 26, magnetic abrading fluid M immersed in and held by the polyurethane layer abrades the surface of the workpiece.

Figure 3:
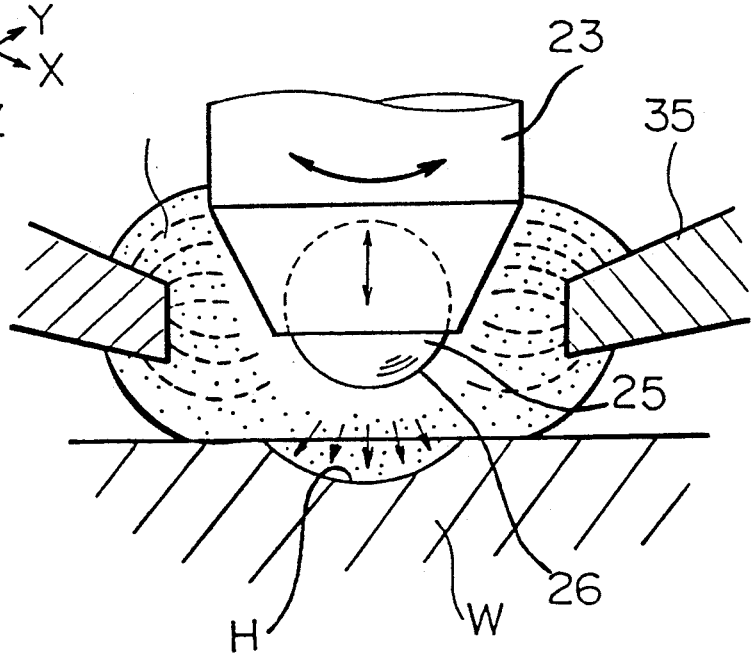
FIG. 3 is an explanatory view for explaining an abrading operation according to the present invention.

According to this embodiment, the abrading section 26 comprises a sphere 25 rotatably held at the lower end of the central yoke 23 as shown in FIG. 3. The surface of the sphere 25 is Sn-plated. The sphere 25 is held at the lower end of the central yoke 23 by the viscosity of the magnetic abrading fluid M, but may be mechanically fitted into the central yoke 23 or magnetically held at the lower end thereof.

Referring to FIG. 1, the driving wire 50 of each actuator 20, 24*x*, and 24*y* is electrically connected with a driving amplifier 51 comprising a 3CH piezoelectric drive amplifier. The 3CH piezoelectric drive amplifier is operated at, for example, 350 V, 100 mA, and 30 kHz. The driving amplifier 51 is connected with a Z-direction signal generator 52 and an XY-direction variable phase two-output signal generator 53. The signal generators 52 and 53 apply a voltage of a predetermined frequency to each actuator 20, 24*x*, and 24*y* via the driving amplifier 51 so as to control the operation thereof.

A non-magnetic cylindrical member 30 is mounted on the main body 10 at the lower surface thereof. The driving wires 50 of actuators 20, 24*x*, and 24*y* are inserted into an opening 31 formed in an intermediate portion of a cylindrical member 30. A ring-shaped magnetic connecting member 32 is screw-connected with the cylindrical member 30 at a lower portion thereof. A part of the inner peripheral surface of the connecting member 32 is adjacent to the peripheral surface of the central yoke 23. The connecting member 32 has a fluid supply path 33 which penetrates therethrough from the peripheral surface thereof to the lower portion of the inner peripheral surface thereof. A fluid supply pipe 34 is connected with the fluid supply path 33 at the peripheral surface thereof. The magnetic abrading fluid supplied to the fluid supply pipe 34 drips to the lower end of the central yoke 23 through the fluid supply path 33 such that drips are supplied in the vicinity of the peripheral surface of the central yoke 23. A permanent magnet 40 comprising a ring-shaped Sm-Co magnet is mounted on the connecting member 32 at a lower end thereof. The intensity of the permanent magnetic 40 is, for example, approximately 5 k Gs. An opposite yoke 35 comprising a magnetic material is fixed to the lower end of the permanent magnet 40. The opposite yoke 35 is conical toward its lower end which is narrowed in its inner peripheral surface and opposed to the lower end of the central yoke 23 with a predetermined gap provided therebetween. Therefore, a magnetic circuit connecting the connecting member 32, the central yoke 23, the opposite yoke 35, and the permanent magnet 40 with each other is constituted and a doughnut-shaped magnetic gap is formed between the central yoke 23 and the opposite yoke 35.

A load cell 60 serving as a load detecting means is provided below the central yoke 23 and the opposite yoke 35. The workpiece W is placed on the load cell 60 for an abrading operation. Upon detection of a load corresponding to pressure applied by the Z-direction actuator 20 to the workpiece W, the load cell 60 outputs a signal indicating the load, or the pressure to the driving amplifier 51 via a controller 61. The pressure applied by the Z-direction actuator 20 to the workpiece W is controlled by feed-back control.

The driving amplifier 51 receives a vibration imparting signal from an FG generator 70 so that vibrations are imparted to the pressure applied by the Z-direction actuator 20 to the workpiece W.

The method according to the present invention to be carried out by using the abrading apparatus of the above construction is described below.

The tool 1 is positioned above the workpiece W placed on the load cell 60. Upon supply of the magnetic abrading fluid M from the supply pipe 34 to the lower end of the central yoke 23, the magnetic abrading fluid M is magnetically held in the vicinity of a magnetic gap between the central yoke 23 and the opposite yoke 35. As illustrated in FIG. 3, the magnetic abrading fluid M is held in the above-described gap in such a manner that the magnetic abrading fluid M covers the lower end portion of the central yoke 23. Thus, the magnetic force causes the magnetic abrading fluid M to be pressed against the surface of the workpiece W.

Upon cyclic application of a voltage to the Z-direction actuator 20, the Z-direction actuator 20 undergoes a slight stretch/contraction motion in the direction (vertical direction in FIG. 1) perpendicular to the surface of the workpiece W. As a result, the abrading section 26 of the central yoke 23 moves slightly in the vertical direction (direction as shown by the vertical arrow in FIG. 3), thus pressing the magnetic abrading fluid M against the surface of the workpiece W. At this time, a voltage is cyclically applied to the actuators 24*x* and, 24*y* and consequently, the block 22 connected with the actuators 24*x* and 24*y* swings horizontally. As a result, the abrading section 26 swings greatly about the connecting section 21 as shown by a circular arc-shaped arrow in FIG. 3. The swinging motion of the abrading section 26 occurs in a micromotion in the horizontal direction (XY-direction) with respect to the surface of the workpiece W. The micromotions of the abrading section 26 in the XY-direction and the Z-direction are transmitted to the magnetic abrading fluid M. As a result, the magnetic abrading fluid M abrades the surface of the workpiece W. Since the magnetic abrading fluid M applies pressure to the workpiece W only in the area between the lower end portion of the central yoke 23 and the workpiece W, the workpiece W is abraded in correspondence with the configuration and size of the motion range of the abrading section 26 of the central yoke 23.

The abrading tool 1 is moved horizontally or in a three-dimensional direction throughout the surface of the workpiece W according to its configuration. Thus, the entire surface of the workpiece W is abraded into a predetermined configuration such as a flat, spherical or freecurved surface.

Since the XY-direction actuators 24*x* and 24*y* are connected with the Z-direction actuator 20 via the connecting section 21, they are capable of moving freely and the pressure of the Z-direction actuator 20 is reliably transmitted to the abrading section 26. Since the regulating fixture 80 restricts the motion of the Z-direction actuator 20 in the XY-direction, neither the connecting section 21 serving as the supporting point of the motion of the XY-direction actuators, 24*x* and 24*y* nor the Z-direction actuator 20 are moved in the XY-direction due to the motion of the XY-direction actuators 24*x* and 24*y* in the XY-direction. Therefore, the abrading section 26 undergoes a micromotion reliably and as such, the surface of the workpiece W is abraded with a high accuracy.

The phase difference between the motion of the abrading section 26 in the X-direction and the motion of the abrading section 26 in the Y-direction is cyclically changed while the workpiece W is being abraded. The motion of the abrading section 26 in the X-Y plane is expressed with respect to the X-coordinate and the Y-coordinate as follows:

$$X = A \sin \omega t \quad (1)$$

$$Y = A \sin (\omega t + \delta) \quad (2)$$

where A is an amplitude, $\omega$ is frequency, t is time, and $\delta$ is the amount of phase change. The phase difference in the X-direction and the Y-direction changes cyclically by increasing and decreasing the value of $\delta$ cyclically. That is, in this example, the phase the abrading section 26 is vibrated in the X-direction at a constant frequency while the vibration of the abrading section 26 in the Y-direction is changed so that the phase thereof relative to the X-direction motion changes, by increasing and decreasing the value of δ.

Figure 4A:
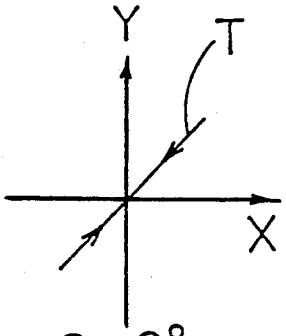
FIGS. 4A–4H are explanatory views showing the motion locus of an abrading section.
Figure 4B:
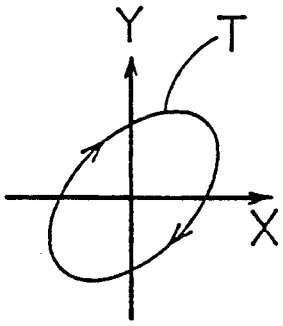
Figure 4C:
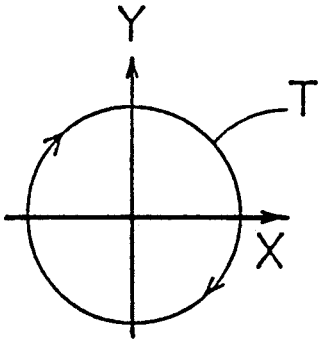
Figure 4D:
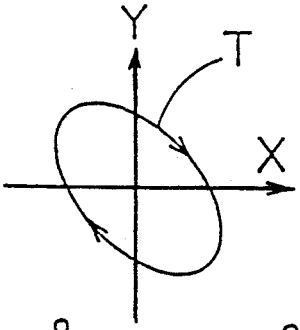
Figure 4E:
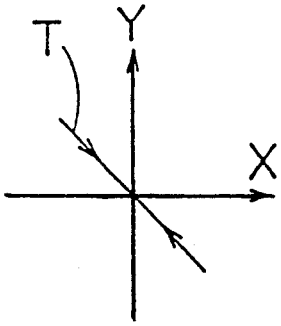
Figure 4F:
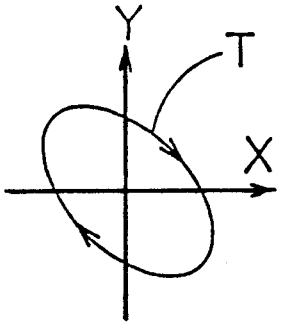
Figure 4G:
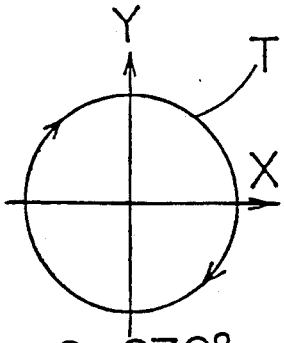
Figure 4H:
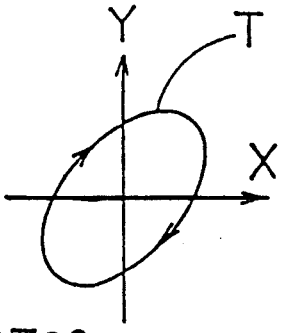
Figure 5:
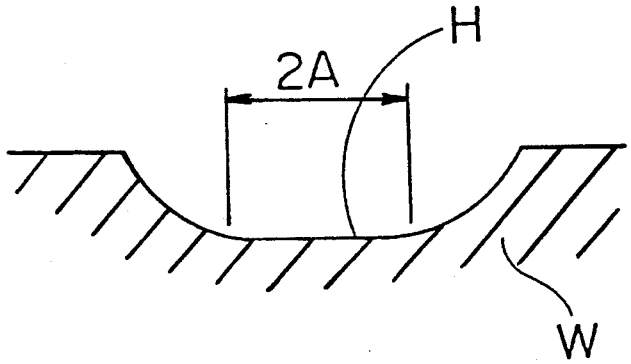
FIG. 5 is a sectional illustration showing a processed surface of a workpiece.
Figure 6:
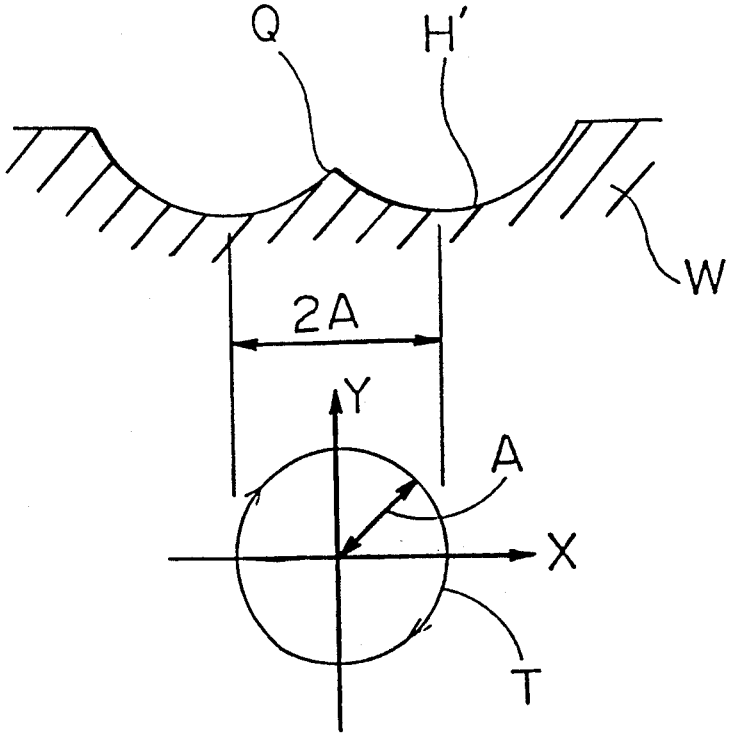
FIG. 6 is an explanatory view showing the sectional configuration of a processed surface of a workpiece and a motion locus of an abrading section according to a conventional method.

FIGS. 4A-AI illustrate the motion locus T of the abrading section 26 which changes according to the value of δ. For example, if $\delta=0°$, a straight line passing through the origin of the X-Y-coordinate is obtained. If $0°<\delta<90°$, the locus of the abrading section 26 is elliptical. If $\delta=90°$, it is a circular arc. If $\delta>90°$, the respective loci are as shown in FIGS. 4D-4I. That is, while δ increases from 0° to 360°, the locus T of the abrading section 26 covers all the area of a circle of radius A which is the amplitude. As a result, as shown in FIG. 5, all the area H in the circle of the radius A of the workpiece W is uniformly abraded.

In addition to the above way of successively changing the motion of the abrading section 26 between a straight line, an ellipse, and a circular arc, the entire surface of the workpiece W may be abraded by moving the abrading section 26 according to an arbitrary Lissajous's between the X-direction motion and the Y-direction motion. figure. That is, the phase difference changed so that the phase thereof relative to the X-direction motion changes, by increasing and decreasing the value of δ of the abrading section 26 may be cyclically changed so that the abrading section 26 undergoes a motion throughout a predetermined area.

The abrading tool 1 is moved horizontally or in a three-dimensional throughout the surface of the workpiece W according to its configuration. Thus, the entire surface of the workpiece W is abraded into a predetermined configuration such as a flat, spherical or free-curved surface.

While the workpiece W is being abraded, in the load cell 60 on which the workpiece W is placed, the value of a load corresponding to pressure applied by the abrading section 26 of the abrading tool 1 to the workpiece W via the magnetic abrading fluid M is detected. Upon detection of the load, a signal is fed back to the driving amplifier 51 via the controller 61. Therefore, if pressure applied to the workpiece W exceeds a predetermined value, the driving amplifier 51 applies a reduced voltage to the Z-direction actuator 20 so that a reduced pressure is applied thereto. If pressure applied to the workpiece W is below the predetermined value, the driving amplifier 51 applies an increased voltage to the Z-direction actuator 20 so that an increased pressure is applied thereto. While one predetermined surface of the workpiece is being processed, the pressure to be applied to the workpiece W decreases with the elapse of time. Therefore, the, load cell 60 detects the decrease of pressure and feeds a signal back to the driving amplifier 51 so that a constant pressure is applied to the workpiece W. The Z-direction signal generator 52 outputs to the driving amplifier 51 a control signal indicating that the pressure is small in the early stage, intermediate in middle the stage, and small in the late stage during an abrading operation. During the abrading operation, the FG generator 70 keeps generating a vibration imparting signal to the driving amplifier 51 so that vibrations are imparted to the pressure applied by the Z-direction actuator 20 to the workpiece W.

Figure 7A:
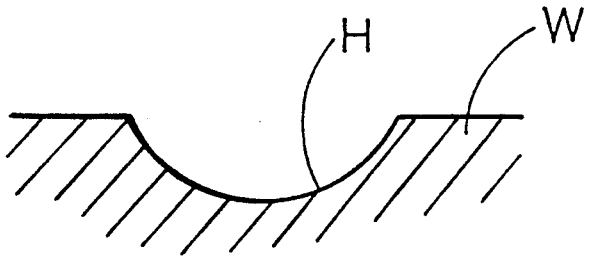
Figure 7B:
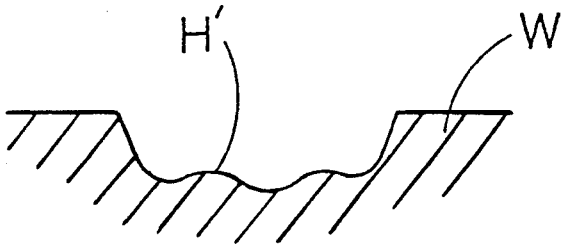

FIG. 7*a* shows the configuration of the surface of the workpiece W abraded by the above-described method. FIG. 7*b* shows the configuration of the surface of the workpiece W abraded by a comparison method in which the fixture 80 is not mounted on the Z-direction actuator 20. In both figures, the motion range of the abrading section 26 is larger than that of the above-described embodiment. According to the comparison method, the surface of the workpiece W is not abraded spherically and evenly, whereas according to the embodiment shown in FIG. 7*a*, the surface is abraded spherically and smoothly.

As described above, the phase difference between the X-direction motion and the Y-direction motion is cyclically changed while the abrading section is undergoing a micromotion. Therefore, the surface of the workpiece is entirely and uniformly abraded even though a large area is abraded. That is, the surface of the workpiece can be abraded with a high efficiency and accuracy irrespective of the size of its surface area.

Further, the Z-direction actuator supports the abrading section via the, connecting section which is capable of undergoing a micromotion in the XY-direction, and the X-direction and Y-direction actuators operate between the connecting section and the abrading section. This construction allows the pressure of the Z-direction actuator to be reliably transmitted to the abrading section without preventing a normal micromotion of the abrading section in the XY-direction. Thus, the abrading operation is favorably performed by the micromotion of the abrading section in the Z-direction and the XY-direction. In addition, the limitation of the motion of the Z-direction actuator in the XY-direction prevents the micromotion of the supporting point of the abrading section in the XY-direction, i.e., the abrading section maintains an accurate locus. Therefore, the surface of the workpiece is accurately and smoothly abraded according to the motion locus of the abrading section. Even a large surface area can be processed accurately and smoothly according to the present invention, which provides an improvement in abrading efficiency.

Although the present invention has been fully described in connection with the preferred embodiments thereof with reference to the accompanying drawings, it is to be noted that various changes and modifications are apparent to those skilled in the art. Such changes and modifications are to be understood as included within the scope of the present invention as defined by the appended claims unless they depart therefrom.

What is claimed is:

1. A micro-abrading method for abrading a workpiece, comprising the steps of:

mounting the workpiece on a support;

providing an abrading tool;

mounting a Z-direction piezoelectric actuator element to a main body of said abrading tool;

connecting an abrading section to said Z-direction piezoelectric actuator element via a connecting section which allows movement of said abrading section relative to said Z-direction piezoelectric actuator element in an X-direction and in a Y-direction orthogonal to said X-direction;

connecting at least one XY-direction piezoelectric actuator element between said main body of said abrading tool and said abrading section;

operating said at least one XY-direction piezoelectric actuator element in order to create micromotion of said abrading section in said X-direction and said Y-direction; and limiting movement of said Z-direction piezoelectric actuator element in said X-direction and said Y-direction while allowing movement of said abrading section in said X-direction and said Y-direction during operation of said at least one XY-direction piezoelectric element, by connecting a movement regulating fixture between said Z-direction piezoelectric actuator element and said main body of said abrading tool.

2. A micro-abrading method as recited in claim 1, further comprising interposing an abrading material between said abrading section and the workpiece.

3. A micro-abrading method as recited in claim 1, further comprising operating said Z-direction piezoelectric actuator element to create micromotion of said abrading section in a Z-direction orthogonal to said X-direction and said Y-direction.

4. A micro-abrading method as recited in claim 3, wherein said connecting section comprises a member which is flexible in said X-direction and said Y-direction and which is substantially rigid in said Z-direction so as to be effective to transmit the micromotion in said Z-direction from said Z-direction piezoelectric actuator element to said abrading section.

5. A micro-abrading method as recited in claim 1, wherein said step of limiting movement of said Z-direction piezoelectric actuator element by connecting said movement regulation fixture comprises connecting an X-direction supporting section between said Z-direction piezoelectric actuator element and said main body of said abrading tool for limiting movement of said Z-direction piezoelectric actuator element in said X-direction, and connecting a Y-direction supporting section between said Z-direction piezoelectric actuator element and said main body of said abrading tool for limiting movement of said Z-direction piezoelectric actuator element in said Y-direction.

6. A micro-abrading method as recited in claim 5, wherein each of said X-direction supporting section and said Y-direction supporting section comprises a horizontally elongated member having vertically narrowed portions to allow for flexibility thereof in the Z-direction.

7. A micro-abrading method as recited in claim 1, wherein said step of connecting said at least one XY-direction piezoelectric actuator element comprises connecting an X-direction piezoelectric actuator element between said main body of said abrading tool and said abrading section, and connecting a Y-direction piezoelectric actuator element between said main body of said abrading tool and said abrading section.

8. A micro-abrading tool for micro-abrading a workpiece, comprising:

a main body;

a Z-direction piezoelectric actuator element mounted to said main body;

an abrading section connected to said Z-direction piezoelectric actuator element;

a connecting section interposed between said abrading section and said Z-direction piezoelectric actuator element for allowing movement of said abrading section relative to said Z-direction piezoelectric actuator element in an X-direction and in a Y-direction orthogonal to said X-direction;

at least one XY-direction piezoelectric actuator element connected between said main body and said abrading section; and a movement regulating fixture mounted between said Z-direction piezoelectric actuator element and said main body for limiting movement of said Z-direction piezoelectric actuator element in said X-direction and in said Y-direction while allowing movement of said abrading section in said X-direction and said Y-direction during operation of said at least one XY-direction piezoelectric actuator element.

9. A micro-abrading tool as recited in claim 8, further comprising:

a support for supporting the workpiece relative to said main body; and an abrading material interposed between said abrading section and the workpiece.

10. A micro-abrading tool as recited in claim 8, wherein said connecting section comprises a member which is flexible in said X-direction and said Y-direction and which is substantially rigid in said Z-direction so as to be effective to transmit micromotion in said Z-direction from said Z-direction piezoelectric actuator element to said abrading section.

11. A micro-abrading tool as recited in claim 8, wherein said movement regulating fixture comprises an X-direction supporting section connected between said Z-direction piezoelectric actuator element and said main body for limiting movement of said Z-direction piezoelectric actuator element in said X-direction, and a Y-direction supporting section connected between said Z-direction piezoelectric actuator element and said main body for limiting movement of said Z-direction piezoelectric actuator element in said Y-direction.

12. A micro-abrading tool as recited in claim 11, wherein each of said X-direction supporting section and said Y-direction supporting section comprises a horizontally elongated member having vertically narrowed portions to allow for flexibility thereof in the Z-direction.

13. A micro-abrading tool as recited in claim 8, wherein said at least one XY-direction piezoelectric actuator element comprises an X-direction piezoelectric actuator element connected between said main body and said abrading section, and a Y-direction piezoelectric actuator element connected between said main body and said abrading section.

* * * * *